US006152219A

United States Patent [19]

Vick, Jr. et al.

[11] Patent Number: 6,152,219

[45] Date of Patent: Nov. 28, 2000

[54] DOWNHOLE PULLING TOOL

[75] Inventors: James D. Vick, Jr.; Mike L. Braby, both of Dallas, Tex.

[73] Assignee: Halliburton Energy Services, Inc.

[21] Appl. No.: 09/240,764

[22] Filed: Jan. 29, 1999

[51] Int. Cl.[7] ..... E21B 33/13

[52] U.S. Cl. ..... 166/117; 166/211; 166/216; 166/217; 166/209; 166/215; 166/181; 166/186

[58] Field of Search ..... 166/117, 181, 166/185, 186, 209, 211, 215–217, 277, 301, 381, 386

[56] References Cited

U.S. PATENT DOCUMENTS

| | | | |
|---|---|---|---|
| 3,950,021 | 4/1976 | Goldschild et al. | 294/86.28 |
| 4,254,983 | 3/1981 | Harris | 294/86.21 |
| 4,545,434 | 10/1985 | Higgins | 166/217 |
| 4,558,895 | 12/1985 | Tamplen | 294/86.18 |
| 4,591,197 | 5/1986 | Akkerman | 294/86.24 |
| 4,745,974 | 5/1988 | Higgins | 166/217 |
| 4,767,145 | 8/1988 | Bullard | 294/86.18 |
| 4,838,594 | 6/1989 | Bullard | 294/86.18 |
| 5,145,228 | 9/1992 | Boyle | 294/86.25 |
| 5,197,773 | 3/1993 | Vick, Jr. | 294/86.18 |

*Primary Examiner*—Roger Schoeppel
*Attorney, Agent, or Firm*—William M. Imwalle; Lawrence R. Youst

[57] ABSTRACT

A downhole pulling tool (100) for retrieving downhole devices (102, 104) from a wellbore is disclosed. The downhole pulling tool (100) includes a mandrel (106) and a sleeve (108) that is slidably disposed about the mandrel (106). The sleeve (108) is moveable in a first direction from a first position to a second position relative to the mandrel (106) and is moveable in a second direction from the second position to a third position relative to the mandrel (106). An engagement member (114) radially extends between the mandrel (106) and the sleeve (108) and is operated from a retracted position to an engagement position when the sleeve (108) is moved to the second position relative to the mandrel (106) after equalization. One or more shearable members (120) also radially extend between the mandrel (106) and the sleeve (108) to limit the movement of the sleeve (108) relative to the mandrel (106) in the second direction until a predetermined axial force shears the shearable members (120) allowing the sleeve (108) to move to the third position relative to the mandrel (106).

22 Claims, 4 Drawing Sheets

10
18
20
12
22
24
26
16
44
28
30
46
42
48
40
32
38
36
14
34

300
306
364
312
362
310
336
338
340
308
307
320
318
322
348
304
316
314
344
342
358
350
324
346
309
356
354
360
352

DOWNHOLE PULLING TOOL

TECHNICAL FIELD OF THE INVENTION

This invention relates, in general, to retrieving downhole devices and, in particular to, a downhole pulling tool for retrieving a downhole device from a location within a wellbore.

BACKGROUND OF THE INVENTION

Wireline equipment is frequently used to install and retrieve downhole devices within a wellbore. The equipment used to install these downhole devices within the wellbore are generally referred to as running tools. The equipment used to retrieve these downhole devices from a wellbore are generally referred to as pulling tools.

Many forms of running tools, pulling tools and combination running and pulling tools have been developed. Typically, these tools engage an external or internal fishing neck on the downhole devices to be run into or pulled from the wellbore on wireline. These tools are typically operated by either upward or downward jarring of the tool. For example, when running a downhole device, upward or downward jarring may be used to lock the device in place. Similarly, upward or downward jarring may be used to operate a downhole device that is previously installed within the wellbore. Upward or downward jarring is also used to engage the fishing neck of a downhole device installed within a wellbore and may be used to unlock the downhole device from the wellbore. Upward or downward jarring is also used to release from the fishing neck of a downhole device after the downhole device is locked in place. In addition, if a downhole device cannot be unlocked, upward or downward jarring may be used to release the running or pulling tool from the downhole device.

Specifically, running tools have been developed to engage the fishing neck of a lock mandrel having a flow control device, such as a plug. Once the running and pulling tool is lowered into the wellbore, upward or downward jarring may be used to install the lock mandrel and flow control device in the wellbore in order to prevent the flow of production fluids therethrough. When it is desired to continue production from the wellbore, the lock mandrel and flow control device must be removed. A pulling tool may then be run downhole to engage the lock mandrel using upward or downward jarring as required to unlock the lock mandrel and flow control device from the wellbore for retrieval.

It has been found, however, that in high pressure wells, the use of conventional pulling tools may result in the pulling tool along with the lock mandrel being blown uphole. Specifically, when the pulling tool engages the fishing neck of the lock mandrel, an equalization valve in the flow control device is typically opened. When the equalization valve is opened, high pressure fluid tends to force the pulling tool up through the wellbore. Since conventional pulling tools engage the fishing neck of the lock mandrel prior to opening the equalization valve, the high pressure fluid forces the pulling tool upward which may unlock the lock mandrel thereby causing the pulling tool, along with the lock mandrel, to be blown uphole. In addition, it has been found that the maximum upward jarring force that may be exerted by a conventional pulling tool on the lock mandrel once the fishing neck is properly engaged is limited by the shear force required to shear the release pin. If the release pin is inadvertently sheared, the pulling tool will release from the lock mandrel, leaving the lock mandrel and the flow control device downhole. If the flow control device has an equalization valve as described above, high pressure fluid may now blow uphole.

Therefore, a need has arisen for a pulling tool which may be used to pull a downhole device from a wellbore. A need has also arisen for such a pulling tool that will not be blown uphole along with the downhole device being retrieved during equalization. A need has further arisen for a pulling tool that may be upwardly jarred without being limited by the shear force that allows emergency release.

SUMMARY OF THE INVENTION

The present invention disclosed herein comprises a pulling tool which may be used to pull downhole devices from a wellbore that will not be blown uphole along with the downhole device being retrieved during equalization and that may be upwardly jarred without inadvertently shearing a release pin. The downhole pulling tool comprises a mandrel and a sleeve slidably disposed about the mandrel. The mandrel is moveable in a first direction from a first position to a second position relative to the sleeve. The mandrel is also moveable in a second direction from the second position to a third position relative to the sleeve.

Radially extending between the mandrel and the sleeve is an engagement member that is disposed within a first opening in the sleeve. The engagement member is operable from a runin or retracted position, when the mandrel is in the first position, to an engagement position when the mandrel is in the second position. Also radially extending between the mandrel and the sleeve is the release pin that is disposed within a second opening of the sleeve and a slot of the mandrel. The release pin limits the relative movement between the mandrel and the sleeve in the second direction until a sufficient force shears the release pin and allows the mandrel to move to the third position relative to the sleeve. As such, movement of the mandrel in the first direction does not shear the release pin. Only movement of the mandrel in the second direction will shear the release pin and allow the downhole pulling tool to return to the retracted position.

The engagement member is positioned adjacent to a radially reduced region of the mandrel during run-in when the mandrel is in the first position relative to the sleeve. The engagement member remains in this position until the mandrel is operated to the second position. Thus, prior to operating the mandrel to the second position, equalization of pressure above and below a downhole device may occur without risk of inadvertently blowing the pulling tool and the downhole device uphole. When the mandrel is operated to the second position relative to the sleeve, the engagement member is outwardly radially shifted by a radially extended region of the mandrel such that the engagement member is in the engagement position with the downhole device. Thereafter, jarring of the pulling tool in the first direction is used to pull the downhole device out of the wellbore. If the pulling process is unsuccessful, the release pin is sheared allowing the mandrel to be operated to the third position relative to the sleeve such that the engagement member is returned to radially reduced region of the mandrel and retracted.

A limiter assembly is disposed between the mandrel and the sleeve. The limiter assembly releasably restrains movement of the sleeve relative to the mandrel. Specifically, the limiter assembly initially releasably restrains movement of the mandrel relative to the sleeve in the first direction when the mandrel is in the first position. The limiter assembly then releasably restrains movement of the mandrel relative to the sleeve in the second direction when the mandrel is in the second position. If the mandrel is moved into the third position relative to the sleeve, the limiter assembly restrains movement of the mandrel relative to the sleeve in the first direction.

The downhole pulling tool may include a cross pin that radially extends between the mandrel and the sleeve. The cross pin is disposed within a third opening in the sleeve and window in the mandrel. The cross pin may limit the relative movement of the mandrel in the second direction relative to the sleeve when the mandrel is moved to the third position.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention is discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the invention.

Figure 1:
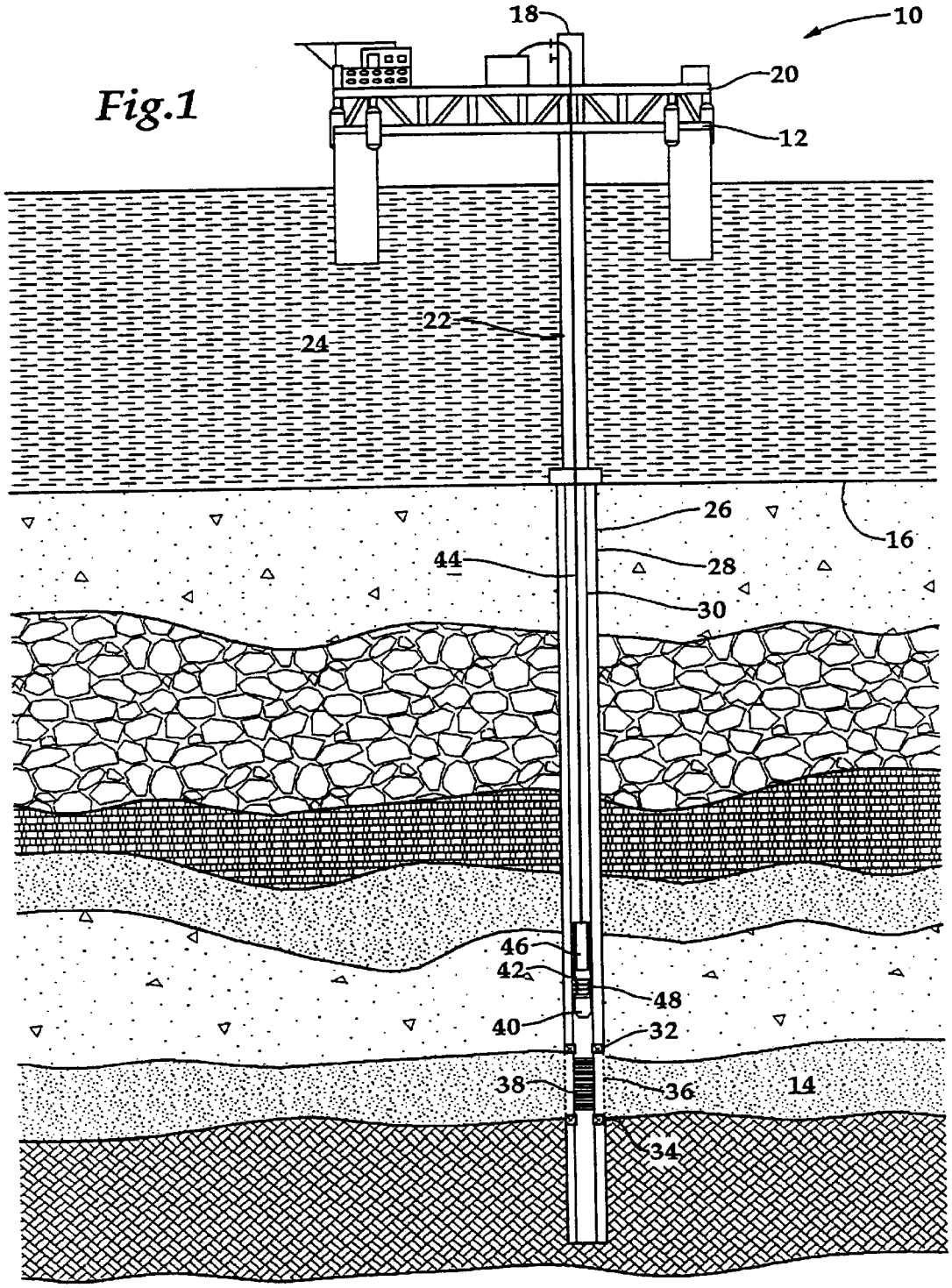
FIG. 1 is a schematic illustration of an offshore oil and gas platform operating a downhole pulling tool of the present invention.

Referring to FIG. 1, a downhole pulling tool in use on an offshore oil and gas production platform is schematically illustrated and generally designated 10. A semi-submersible platform 12 is centered over a submerged oil and gas formation 14 located below sea floor 16. Wellhead 18 is located on deck 20 of platform 12. Well 22 extends through the sea 24 and penetrates the various earth strata including formation 14 to form wellbore 26. Disposed within wellbore 26 is casing 28 that may be cemented in place within wellbore 26. Disposed within casing 28 and extending from wellhead 18 is production tubing 30. A pair of seal assemblies 32, 34 provide a seal between tubing 30 and casing 28 to prevent the flow of production fluids therebetween. During production, formation fluids enter wellbore 26 through perforations 36 and sand control screen 38 to travel into tubing 30 for transmission to wellhead 18.

When it is desired to shut in well 22 for an extended period of time, it is typically necessary to insert a plug 40 into tubing 30. This is achieved by running plug 40 and lock mandrel 42 downhole via a wireline 44. Lock mandrel 42 is carried on a downhole running tool that is coupled to the lower end of wireline 44. During installation, lock mandrel 42 is run through a landing nipple 48. Lock mandrel 42 is then pulled upwardly through landing nipple 48 such that the keys of lock mandrel 42 engages the profile within landing nipple 48. Once in place, further upward travel of lock mandrel 42 relative to landing nipple 48 is prevented. As lock mandrel 42 is carrying plug 40, the flow of production fluids through tubing 30 is now prevented.

When it is desired to reestablish production from formation 14, plug 40 must be removed from tubing 30. This is achieved using downhole pulling tool 46 which is run downhole via wireline 44. Once downhole pulling tool 46 reaches lock mandrel 42, downhole pulling tool 46 may, in some embodiments, operate an equalization valve in plug 40, as will be more fully explained below, to allow the pressure above and below downhole pulling tool 46 to equalize. During this equalization process, downhole pulling tool 46 does not engage lock mandrel 42. Once equalization is complete, downhole pulling tool 46 may be pulled upwardly by wireline 44 to engage lock mandrel 42. Continued upward tension on wireline 44 causes the keys of lock mandrel 42 to disengage the profile of landing nipple 48 such that downhole pulling tool 46, lock mandrel 42 and plug 40 may be removed from wellbore 26 and production from formation 14 may be reestablished.

Even though FIG. 1 depicts a cased vertical well, it should be noted by one skilled in the art that downhole pulling tool 46 of the present invention is equally well-suited for use in, for example, uncased wells, deviated wells, inclined wells or horizontal wells. As such, it should be apparent to those skilled in the art that the use of directional terms such as above, below, upper, lower, upward, downward and the like are used in relation to the illustrative embodiments as they are depicted in the figures, the upward direction being towards the top of the corresponding figure and the downward direction being toward the bottom of the corresponding figure. Therefore, it s to be understood that downhole pulling tool 46 of the present invention may be operated in vertical, horizontal, inverted or inclined orientations without deviating from the principles of the present invention.

Referring now to FIGS. 2A–2D, therein is disclosed one embodiment of the downhole pulling tool of the present invention shown in its various positions that is generally designated 100. For convenience, downhole pulling tool 100 has been depicted in its various operating positions in relation to lock mandrel 102 and plug 104. It should be noted, however, that downhole pulling tool 100 may used for retrieving a variety of downhole devices without departing from the principles of the present invention.

Figures 2A, 2B, 2C, 2D:
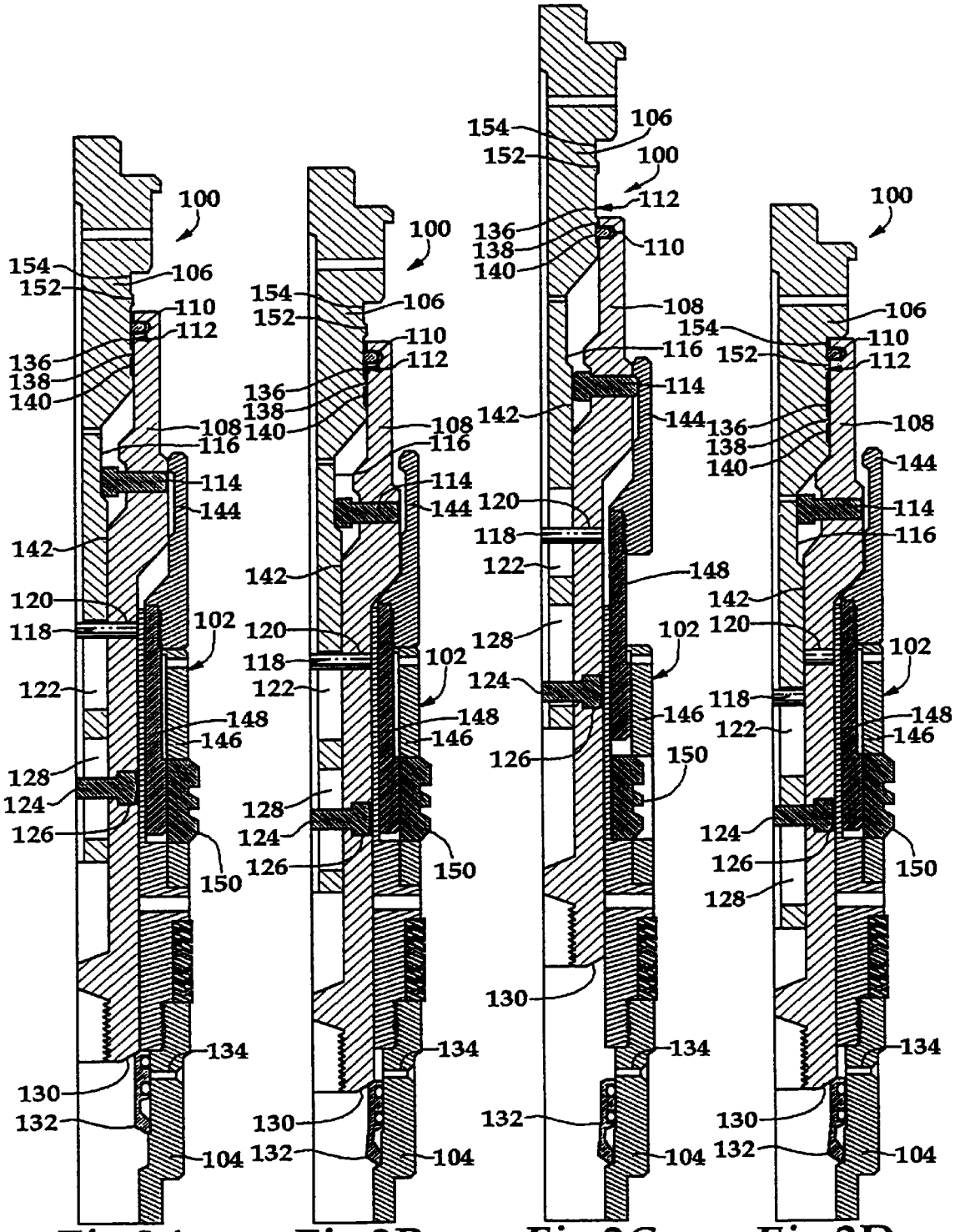
FIGS. 2A–2D are quarter-sectional views of a downhole pulling tool of the present invention in its various positions.

In FIG. 2A, downhole pulling tool 100 is in its running position and is depicted as it enters lock mandrel 102. Downhole pulling tool 100 includes a mandrel 106. A sleeve 108 is slidably disposed about mandrel 106. Between mandrel 106 and sleeve 108 is a limiter assembly such as c-ring 110. The relative movement between mandrel 106 and sleeve 108 is defined by c-ring 110 as c-ring 110 moves within profile 112 of mandrel 106. An engagement member 114 radially extends between mandrel 106 and sleeve 108. In the running position as seen in FIG. 2A, engagement member 114 is positioned adjacent to a radially reduce portion 116 of mandrel 106. In this configuration, engagement member 114 is in a retracted position.

A release pin such as shearable member 118 radially extends between mandrel 106 and sleeve 108. Shearable member 118 is received within an opening 120 of sleeve 108 and extends into a slot 122 of mandrel 106. A cross pin 124 also extends between mandrel 106 and sleeve 108. Cross pin 124 is received within an opening 126 of sleeve 108 and extends into a window 128 of mandrel 106.

At the lower end of mandrel 106 is a shoulder 130 that operates valve 132 of plug 104 from the closed position to the open position when downhole pulling tool 100 is inserted into lock mandrel 102, as best seen in FIG. 2B. Once valve 132 is open, the pressure below plug 104 travels through fluid passageway 134 to equalize the pressure above and below downhole pulling tool 100. Importantly, during the equalization process, downhole pulling tool 100 may be forced uphole by the fluid traveling through fluid passageway 134. As downhole pulling tool 100 is forced uphole, however, lock mandrel 102 is not effected as downhole pulling tool 100 has not engaged lock mandrel 102.

Once the equalization process has been completed, mandrel 106 is pulled upwardly by wireline 44 of FIG. 1. Mandrel 106 then shifts upwardly relative to sleeve 108, as best seen in FIG. 2C. As mandrel 106 shifts, c-ring 110 moves within profile 112 from channel 136 over annular flange 138 to channel 140. During the shift of mandrel 106 relative to sleeve 108, shearable member 118 travels within slot 122 and cross pin 124 travels within window 128. At the same time, engagement member 114 is outwardly radially shifted by a radially extended portion 142 of mandrel 106. In this configuration, engagement member 114 is radially extended to engage the fish neck 144 of lock mandrel 102.

Continued upward movement of downhole pulling tool 100 now creates travel between fish neck 144 and key retainer 146 of lock mandrel 102. As fish neck 144 shifts relative to key retainer 146, key support 148 also travels upwardly allowing key 150 to be retracted from the profile of a landing nipple (not shown). Once key 150 has been retracted, downhole pulling tool 100, lock mandrel 102 and plug 104 may be retrieved from the wellbore. Considerable upward jarring may be required to retract key 150. This upward jarring, however, will not inadvertently cause downhole pulling tool 100 to release from lock mandrel 102 as cross pin 124 prevents the relative movement between mandrel 106 and sleeve 108 from shearing shearable member 118.

If this upward jarring is unable to retract key 150 from the profile of the landing nipple, mandrel 106 may be shifted downwardly relative to sleeve 108, as best seen in FIG. 2D. As mandrel 106 shifts, c-ring 110 moves within profile 112 from channel 140 over annular flange 138 through channel 136 over annular flange 152 into channel 154. During the shift of mandrel 106 relative to sleeve 108, shearable member 118 initially prevent full travel of mandrel 106 relative to sleeve 108 until a predetermined shear force is created therebetween. Once this shear force is exceeded, shearable member 118 shears to allow additional downward movement by mandrel 106 relative to sleeve 108. During the downward travel of mandrel 106, cross pin 124 travels within window 128 and eventually stops the relative movement between mandrel 106 and sleeve 108. Additionally, engagement member 114 returns to a position adjacent to radially reduced portion 116 of mandrel 106. In this configuration, engagement member 114 disengages fish neck 144 of lock mandrel 102 such that downhole pulling tool 100 may be retrieved from the wellbore without lock mandrel 102.

Referring now to FIGS. 3A–3D, therein is disclosed another embodiment of the downhole pulling tool of the present invention shown in its various position that is generally designated 200. For convenience, downhole pulling tool 200 has been depicted in its various operating positions in relation to lock mandrel 202 and plug 204. It should be noted, however, that downhole pulling tool 200 may used for setting and retrieving a variety of downhole devices without departing from the principles of the present invention.

Figures 3A, 3B, 3C, 3D:
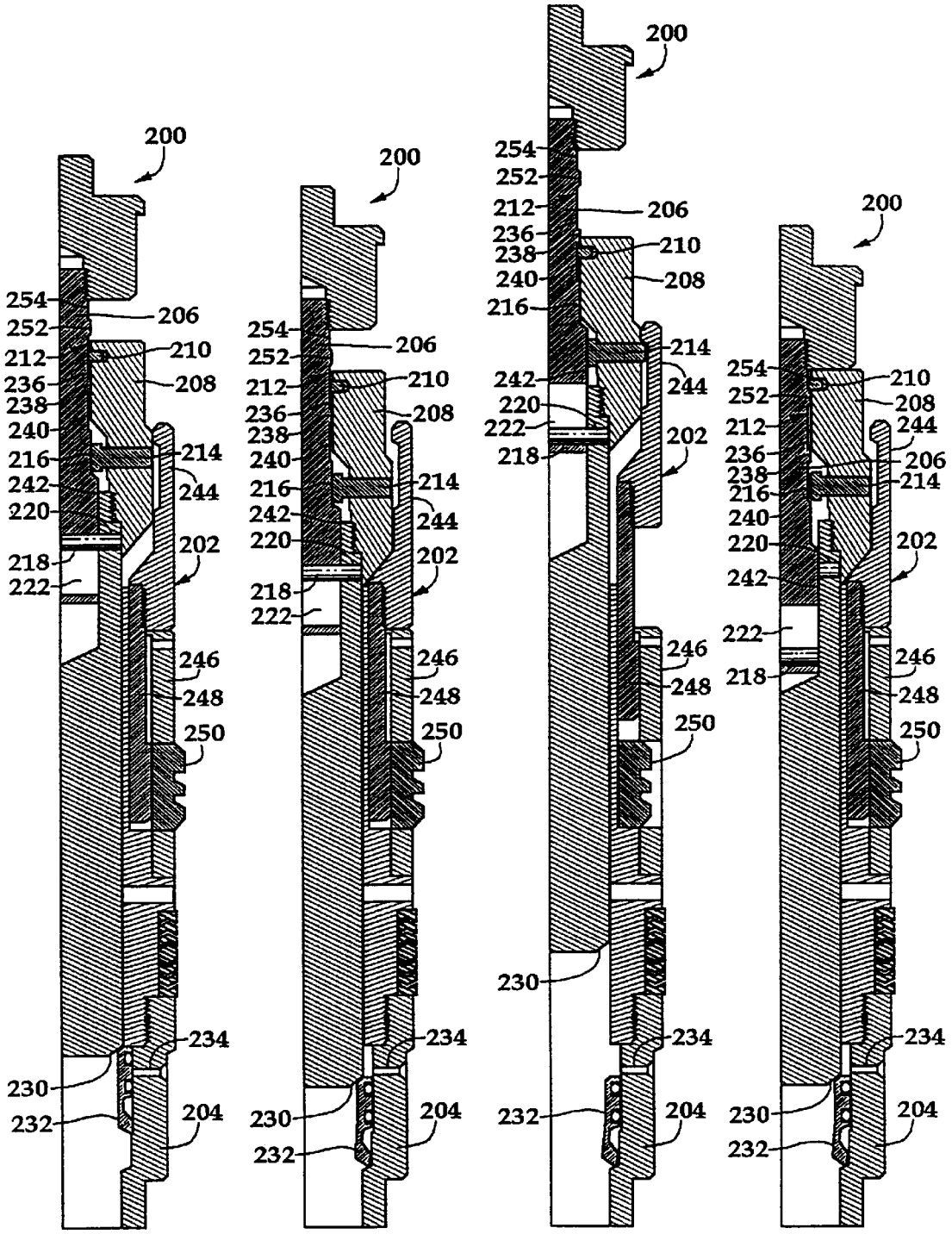
FIGS. 3A–3D are quarter-sectional views of a downhole pulling tool of the present invention in its various positions.

In FIG. 3A, downhole pulling tool 200 is in its running position and is depicted as it enters lock mandrel 202. Downhole pulling tool 200 includes a mandrel 206. A sleeve 208 is slidably disposed about mandrel 206. Between mandrel 206 and sleeve 208 is a c-ring 210. The relative movement between mandrel 206 and sleeve 208 is defined by c-ring 210 as c-ring 210 moves within profile 212 of mandrel 206. An engagement member 214 radially extending between mandrel 206 and sleeve 208. In the running position as seen in FIG. 3A, engagement member 214 is positioned adjacent to a radially reduce portion 216 of mandrel 206. In this configuration, engagement member 214 is in a retracted position.

A shearable member 218 radially extends between mandrel 206 and sleeve 208. Shearable member 218 is received within an opening 220 of sleeve 208 and extends into a slot 222 of mandrel 206. At the lower end of mandrel 206 is a shoulder 230 that operates valve 232 of plug 204 from the closed position to the open position when downhole pulling tool 200 is inserted into lock mandrel 202, as best seen in FIG. 3B. Once valve 232 is open, the pressure below plug 204 travels through fluid passageway 234 to equalize the pressure above and below downhole pulling tool 200. Importantly, during the equalization process, downhole pulling tool 200 may be forced uphole by the fluid traveling through fluid passageway 234. As downhole pulling tool 200 is forced uphole, however, lock mandrel 202 is not effected as downhole pulling tool 200 has not engaged lock mandrel 202.

Once the equalization process has been completed, mandrel 206 is pulled upwardly by wireline 44 of FIG. 1. Mandrel 206 then shifts upwardly relative to sleeve 208, as best seen in FIG. 3C. As mandrel 206 shifts, c-ring 210 moves within profile 212 from channel 236 over annular flange 238 to channel 240. During the shift of mandrel 206 relative to sleeve 208, shearable member 218 travels within slot 222. At the same time, engagement member 214 is outwardly radially shifted by a radially extended portion 242 of mandrel 206. In this configuration, engagement member 214 is radially extended to engage the fish neck 244 of lock mandrel 202.

Continued upward movement of downhole pulling tool 200 now creates travel between fish neck 244 and key retainer 246 of lock mandrel 202. As fish neck 244 shifts relative to key retainer 246, key support 248 also travels upwardly allowing key 250 to be retracted from the profile of a landing nipple (not shown). Once key 250 has been retracted, downhole pulling tool 200, lock mandrel 202 and plug 204 may be retrieved from the wellbore.

If, however, key 250 does not retract from the profile of the landing nipple, mandrel 206 may be shifted downwardly relative to sleeve 208, as best seen in FIG. 3D. As mandrel 206 shifts, c-ring 210 moves within profile 212 from channel 240 over annular flange 238 through channel 236 over annular flange 252 into channel 254. During the shift of mandrel 206 relative to sleeve 208, shearable member 218 initially prevent full travel of mandrel 206 relative to sleeve 208 until a predetermined shear force is created therebetween. Once this shear force is exceeded, shearable member 218 shears to allow additional downward movement by mandrel 206 relative to sleeve 208. Additionally, engagement member 214 returns to a position adjacent to radially reduced portion 216 of mandrel 206. In this configuration, engagement member 214 disengages fish neck 244 of lock mandrel 202 such that downhole pulling tool 200 may be retrieved from the wellbore without lock mandrel 202.

Figures 4A, 4B, 4C:
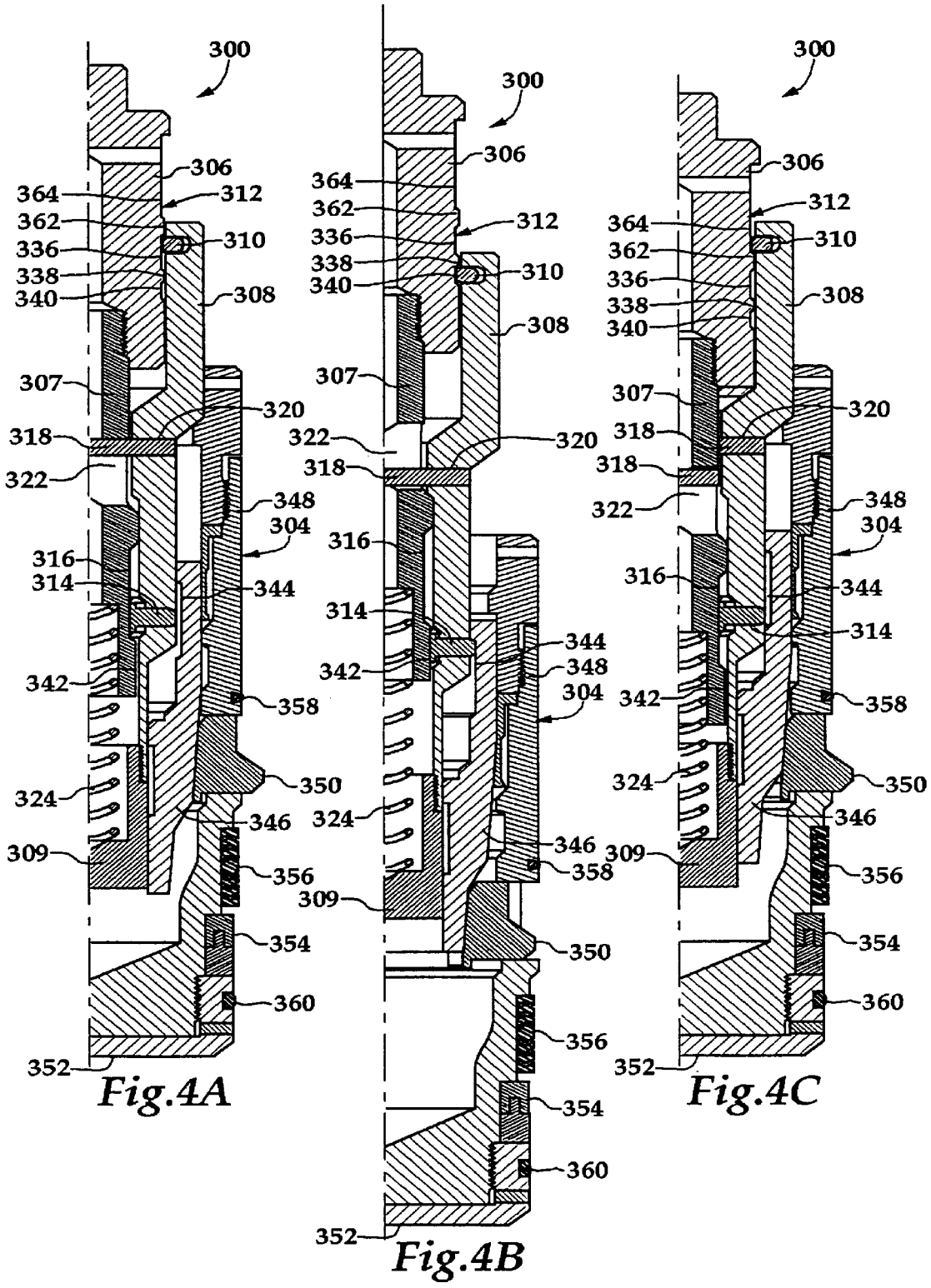
FIGS. 4A–4C are quarter-sectional views of a downhole pulling tool of the present invention in its various positions.

Referring now to FIGS. 4A–4C, therein is disclosed another embodiment of the downhole pulling tool of the present invention shown in its various positions that is generally designated 300. For convenience, downhole pulling tool 300 has been depicted in its various operating positions in relation to plug 304. It should be noted, however, that downhole pulling tool 300 may used for retrieving a variety of downhole devices without departing from the principles of the present invention.

In FIG. 4A, downhole pulling tool 300 is in its running position and is depicted within plug 304. Downhole pulling tool 300 has a mandrel 306 including lower mandrel section 307. A sleeve 308 is slidably disposed about mandrel 306. Sleeve 308 terminates in sleeve cap 309. Between mandrel 306 and sleeve 308 is a limiter assembly Ouch as c-ring 310. The relative movement between mandrel 306 and sleeve 308 is defined by c-ring 310 as c-ring 310 moves within profile 312 of mandrel 306. An engagement member 314 radially extends between mandrel 306 and sleeve 308. In the running position as seen in FIG. 4A, engagement member 314 is positioned adjacent to a radially reduce portion 316 of mandrel 306. In this configuration, engagement member 314 is in a retracted position. A shearable member 318 radially extends between mandrel 306 and sleeve 308. Shearable member 318 is received within an opening 320 of sleeve 308 and extends into a slot 322 of lower mandrel section 307. A spring 324 upward bias mandrel 306 and relative to sleeve 308.

Once downhole pulling tool 300 is disposed within plug 304, mandrel 306 is pulled upwardly by wireline 44 of FIG. 1. Mandrel 306 then shifts upwardly relative to sleeve 308, as best seen in FIG. 4B. As mandrel 306 shifts, c-ring 310 moves within profile 312 from channel 336 over annular flange 338 to channel 340. During the shift of mandrel 306 relative to sleeve 308, shearable member 318 travels within slot 322 with no shear force being applied to shearable member 318, thereby preventing an inadvertent release of downhole pulling tool 300 from plug 304. At the same time, engagement member 314 is outwardly radially shifted by a radially extended portion 342 of lower mandrel section 307. In this configuration, engagement member 314 is radially extended to engage the fish neck 344 of plug 304.

Plug 304 includes an expander sleeve 346, an outer housing 348, a series of circumferentially spaced apart keys 350 and an end cap 352. Configured as shown in FIG. 4B, keys 350 are radially inwardly retracted within housing 348, so that, for example, plug 304 may be conveniently transported by wireline or other conveyance from the earth's surface to the wellbore. Plug 304 is set within the wellbore by the axially downwardly displacing expander sleeve 346, thereby forcing keys 350 radially outward into engagement with the wellbore as depicted in FIG. 4A.

A seal 354 and a packing stack 356 are circumferentially and externally disposed on outer housing 348. Wiper rings 358 and 360 (preferably, o-rings) are circumferentially and externally disposed on the outer housing 348 and end cap 352, respectively. Seal 354 provides primary sealing engagement between plug 304 and the wellbore, while the packing 356 serves as a backup or secondary seal therebetween. Wiper 360 wipes debris from the wellbore prior to seal 354 entering its seal bore. Wiper 358 helps prevent debris from accumulating about keys 350 from above plug 304.

To pull plug 304 from the wellbore, downhole pulling tool 300 is upwardly shifted as described above. Upward jarring of downhole pulling tool 300 then creates travel between expander sleeve 346 and outer housing 348 of plug 304. As expander sleeve 346 shifts relative to outer housing 348, keys 350 are retracted from the profile of a landing nipple (not shown). Once keys 350 have been retracted, downhole pulling tool 300 and plug 304 may be retrieved from the wellbore.

If, however, keys 350 do not retract from the profile of the landing nipple, mandrel 306 may be shifted downwardly relative to sleeve 308, as best seen in FIG. 4C. As mandrel 306 shifts, c-ring 310 moves within profile 312 from channel 340 over annular flange 338 through channel 336 over annular flange 362 into channel 364. During the shift of mandrel 306 relative to sleeve 308, shearable member 318 initially prevent full travel of mandrel 306 relative to sleeve 308 until a predetermined shear force is created therebetween. Once this shear force is exceeded, shearable member 318 shears to allow additional downward movement by mandrel 306 relative to sleeve 308. Additionally, engagement member 314 returns to a position adjacent to radially reduced portion 316 of mandrel 306. In this configuration, engagement member 314 disengages fish neck 344 of expander sleeve 1346 such that downhole pulling tool 300 may be retrieved from the wellbore without plug 304.

While this invention has been described with a reference to illustrative embodiments, this description is not intended to be construed in a limiting sense. Various modifications and combinations of the illustrative embodiments as well as other embodiments of the invention, will be apparent to persons skilled in the art upon reference to the description. It is therefore, intended that the appended claims encompass any such modifications or embodiments.

What is claimed is:

1. A downhole pulling tool for retrieving a downhole device from a wellbore comprising:

a mandrel;

a sleeve slidably disposed about the mandrel, the sleeve moveable in a first direction from a first position to a second position relative to the mandrel and moveable in a second direction from the second position to a third position relative to the mandrel;

at least one engagement member partially disposed between the mandrel and the sleeve, the at least one engagement member radially extendable between a retracted configuration when the sleeve is in the first and third positions and an engagement configuration when the sleeve is in the second position;

at least one shearable member radially extending between the mandrel and the sleeve, the at least one shearable member allowing free movement of the sleeve in a first direction from the first position to the second position, the at least one shearable member releasably limiting the movement of the sleeve in the second direction until a predetermined force shears the at least one shearable member, thereby allowing the sleeve to move to the third position and;

a cross pin radially extending between the mandrel and the sleeve, the cross pin limiting the relative movement of the sleeve in the second direction relative to the mandrel when the sleeve is moved to the third position relative to the mandrel.

2. The downhole pulling tool as recited in claim 1 wherein the at least one engagement member is positioned adjacent to a radially reduced region of the mandrel when the sleeve is in the first position relative to the mandrel and is positioned adjacent to a radially extended region of the mandrel when the sleeve is in the second position relative to the mandrel.

3. The downhole pulling tool as recited in claim 1 wherein the at least one engagement member is positioned adjacent to a radially reduced region of the mandrel when the sleeve is in the third position relative to the mandrel.

4. The downhole pulling tool as recited in claim 1 further comprising a limiter assembly disposed between the mandrel and the sleeve, the limiter assembly releasably restraining movement of the sleeve in the first direction relative to the mandrel when the sleeve is in the first position.

5. The downhole pulling tool as recited in claim 1 further comprising a limiter assembly disposed between the mandrel and the sleeve, the limiter assembly releasably restraining movement of the sleeve in the second direction relative to the mandrel when the sleeve is in the second position.

6. The downhole pulling tool as recited in claim 1 further comprising a limiter assembly disposed between the mandrel and the sleeve, the limiter assembly restraining movement of the sleeve in the first direction relative to the mandrel when the sleeve is in the third position.

7. A downhole pulling tool for retrieving a downhole device having an equalization valve, the tool comprising:

at least one engagement member partially disposed between a mandrel and a sleeve, the sleeve slidably disposed about the mandrel, the at least one engagement member radially extendable between retracted and engagement configurations, the at least one engagement member remaining in the retracted configuration during equalization after the tool opens the equalization valve of the downhole device and shifting from the retracted configuration to the engagement configuration when the sleeve is moved in a first direction relative to the mandrel.

8. The downhole pulling tool as recited in claim 7 wherein the at least one engagement member is positioned adjacent to a radially reduced region of the mandrel when the at least one engagement member is in the retracted configuration.

9. The downhole pulling tool as recited in claim 7 wherein the at least one engagement member is positioned adjacent to a radially extended region of the mandrel when the at least one engagement member is in the engagement configuration.

10. The downhole pulling tool as recited in claim 7 further comprising a limiter assembly disposed between the mandrel and the sleeve, the limiter assembly releasably restraining movement of the sleeve in the first direction relative to the mandrel when the at least one engagement member is in the retracted configuration.

11. The downhole pulling tool as recited in claim 7 further comprising a limiter assembly disposed between the mandrel and the sleeve, the limiter assembly releasably restraining movement of the sleeve in a second direction relative to the mandrel when the at least one engagement member is in the engagement configuration.

12. The downhole pulling tool as recited in claim 7 further comprising a limiter assembly disposed between the mandrel and the sleeve, the limiter assembly restraining movement of the sleeve in the first direction relative to the mandrel once the shearable member has been sheared.

13. The downhole pulling tool as recited in claim 7 further comprising a cross pin radially extending between the mandrel and the sleeve, the cross pin limiting the relative movement of the sleeve in the second direction relative to the mandrel once the shearable member has been sheared.

14. A downhole pulling tool for retrieving a downhole device having an equalization valve, the tool comprising:

a sleeve disposed about a mandrel that is slidable in a first direction between first and second positions relative to the mandrel and slidable in a second direction between the second position and a third position relative to the mandrel;

at least one engagement member partially disposed between the mandrel and the sleeve, the at least one engagement member remaining in a retracted position during equalization after the tool opens the equalization valve of the downhole device, the at least one engagement member operably engageable with the downhole device when the sleeve is operated from the first position to the second position; and at least one shearable member radially extending between the mandrel and the sleeve, the at least one shearable member allowing free movement of the sleeve in a first direction from the first position to the second position, the at least one shearable member releasably limiting the movement of the sleeve in the second direction until a predetermined force shears the at least one shearable member, thereby allowing the sleeve to move to the third position.

15. The downhole pulling tool as recited in claim 14 wherein the at least one engagement member is positioned adjacent to a radially reduced region of the mandrel when the sleeve is in the first position relative to the mandrel.

16. The downhole pulling tool as recited in claim 14 wherein the at least one engagement member is positioned adjacent to a radially extended region of the mandrel when the sleeve is in the second position relative to the mandrel.

17. The downhole pulling tool as recited in claim 14 wherein the at least one engagement member is positioned adjacent to a radially reduced region of the mandrel when the sleeve is in the third position relative to the mandrel.

18. The downhole pulling tool as recited in claim 14 further comprising a limiter assembly disposed between the mandrel and the sleeve, the limiter assembly releasably restraining movement of the sleeve relative to the mandrel.

19. The downhole pulling tool as recited in claim 18 wherein the limiter assembly releasably restrains movement of the sleeve in the first direction relative to the mandrel when the sleeve is in the first position.

20. The downhole pulling tool as recited in claim 18 wherein the limiter assembly releasably restrains movement of the sleeve in the second direction relative to the mandrel when the sleeve is in the second position.

21. The downhole pulling tool as recited in claim 18 wherein the limiter assembly restrains movement of the sleeve in the first direction relative to the mandrel when the sleeve is in the third position.

22. The downhole pulling tool as recited in claim 14 further comprising a cross pin radially extending between the mandrel and the sleeve, the cross pin limiting the relative movement of the sleeve in the second direction relative to the mandrel when the sleeve is moved to the third position relative to the mandrel.

* * * * *